US008109011B2

(12) United States Patent
Prajescu

(10) Patent No.: US 8,109,011 B2
(45) Date of Patent: Feb. 7, 2012

(54) CLOTHES DRYER BULKHEAD RECESS

(75) Inventor: Gabriel Prajescu, Dollard-des-Ormeaux (CA)

(73) Assignee: Mabe Canada, Inc., Burlington, Ontario ( * ) Notice: Subject to any disclaimer, the term of this patent is extended or adjusted under 35 U.S.C. 154(b) by 847 days.

(21) Appl. No.: 12/222,629

(22) Filed: Aug. 13, 2008

(65) Prior Publication Data

US 2009/0083987 A1 Apr. 2, 2009

(30) Foreign Application Priority Data

Sep. 28, 2007 (CA) ..... 2604666

(51) Int. Cl.
*D06F 58/06* (2006.01)

(52) U.S. Cl. ..... 34/601; 34/595; 34/603; 34/139

(58) Field of Classification Search ..... 34/595, 34/601, 603, 139
See application file for complete search history.

(56) References Cited

U.S. PATENT DOCUMENTS

| | | | | |
|---|---|---|---|---|
| 4,854,054 | A * | 8/1989 | Johnson | 34/603 |
| 4,899,464 | A * | 2/1990 | Carr et al. | 34/604 |
| 2006/0265959 | A1 * | 11/2006 | Renzo | 49/381 |

* cited by examiner

*Primary Examiner* — Jiping Lu

(57) ABSTRACT

A bulkhead structure for a clothes dryer has a generally cylindrical outer wall that fits within an open end of the clothes dryer drum to define a junction. The bulkhead has two side wall portions facing into the drum on opposing sides of a bulkhead access opening. Each of the side wall portions has a recess extending from the bulkhead access opening towards the cylindrical outer wall. The recess has a concave curvature terminating in an outer deflection wall inwardly spaced from the cylindrical outer wall. The recess and the outer deflection cause clothing contacting the recess and moving towards the dryer drum to be swept away from the junction.

18 Claims, 4 Drawing Sheets

CLOTHES DRYER BULKHEAD RECESS

FIELD OF THE INVENTION

The present invention relates to a clothes dryer front bulkhead structure mounted relative to a front panel of the dryer cabinet and positioned within an open end of a rotating drum. More particularly, at least a portion of the front bulkhead structure is structured to direct clothing away from the junction between the front bulkhead and the drum.

BACKGROUND TO THE PRESENT INVENTION

Various bearing structures have been used to support the rotating dryer drum within the cabinet of a dryer. Such support may take the form of a substantially axial shaft extending from the closed end of the drum and received in a suitable bearing. More generally there are bearings on both ends of the drum. In some instances the front bearing also provides a front bulkhead adjacent the open end of the dryer drum that fits into this open end.

In one front bulkhead structure, the bulkhead comprises upper and lower structural portions fitted together and mounted to the front panel of the dryer cabinet by snapping hooks and/or screws. The two bearing structural portions provide a ring like bearing support surface and form a stationary front bulkhead within the open end of the clothes dryer drum. The front bulkhead faces into the dryer drum and includes a clothes access opening through which clothing may enter the drum when the clothes dryer door, mounted to the front panel of the dryer, is opened. In some cases the front bulkhead has a grill like portion located below the clothes access opening. The grill portion has a series of air flow openings through which air leaves the dryer drum. As the dryer drum rotates it tumbles the clothing in the drum. During tumbling, the clothing comes into contact with the front bulkhead and the inside surface of the closed door. In some instances, the clothing has been known to contact the junction between the stationary bulkhead and the rotating drum. While tolerances at this junction are quite small, clothing can sometimes temporarily enter any gap in the junction between the dryer drum wall and the stationary bulkhead wall. This can damage or soil the clothing. Clearly, any improvements in clothes dryer construction that would reduce the risk of clothing contacting the junction between the stationary bulkhead and the rotating dryer drum would be advantageous.

BRIEF DESCRIPTION OF THE INVENTION

The present invention relates to a clothes dryer front bulkhead structure mounted relative to a front panel of the dryer cabinet and positioned within an open end of a rotating drum. Side wall portions of the front bulkhead structure each have recessed surface portions with an outer deflection wall for directing clothing away from a junction between the front bulkhead and the drum.

The bulkhead structure comprises a generally cylindrical outer wall that fits within an open end of the clothes dryer drum to define the junction. The side wall portions face into the drum on opposing sides of a bulkhead access opening. Each of the side wall portions has a recess extending from the bulkhead access opening towards the cylindrical outer walls. The recess terminates in an outer deflection wall inwardly spaced from the cylindrical outer wall. The outer deflection wall causes clothing contacting the recess and moving towards the dryer drum to be deflected away from the junction adjacent the recess.

In one embodiment, the recess has a concave curvature adjacent the outer deflection wall resulting in the clothing being swept away from the junction. In alternative embodiments, the recess may not have a concave curvature adjacent the outer deflection wall and the outer deflection wall may extend outwardly from the recess at an angle of 90 degrees or any other suitable sloping angle.

In an embodiment, the outer deflection wall extends generally parallel to the cylindrical outer wall.

In an embodiment, the side wall portions each define a generally normal wall portion facing into the drum between the outer deflection wall and the cylindrical outer wall. The outer deflection wall includes at least one flange extending therefrom and into the dryer drum farther than the normal wall to facilitate deflection of clothing articles away from the junction.

In accordance with an embodiment of the invention there is provided a clothes dryer comprising a dryer drum having an open end and a bulkhead structure fitting into the open end of the dryer drum. The bulkhead structure has an access opening of reduced area to that of the open end of the dryer. The bulkhead structure comprises a generally cylindrical outer wall and two side wall portions. The generally cylindrical outer wall fits within the open end of the dryer drum and forms a junction with the open end of the dryer drum. The two side wall portions face into the drum on opposing sides of the bulkhead access opening. The side wall portions each comprise a recess extending from the bulkhead access opening towards the cylindrical outer wall. The recess terminates in an outer deflection wall inwardly spaced from the cylindrical outer wall. The outer deflection wall causes clothing contacting the recess and moving towards the dryer drum to be directed from the junction adjacent the recess.

BRIEF DESCRIPTION OF THE DRAWINGS

For a better understanding of the nature and objects of the present invention reference may be had by way of example to the accompanying diagrammatic drawings in which.

DETAILED DESCRIPTION OF THE INVENTION

The present invention relates to a clothes dryer front bulkhead structure mounted relative to a front panel of the dryer cabinet and positioned within an access opening of a rotating drum. More particularly, the front bulkhead structure is structured to direct clothing away from the junction between the front bulkhead and the drum.

Figure 1:
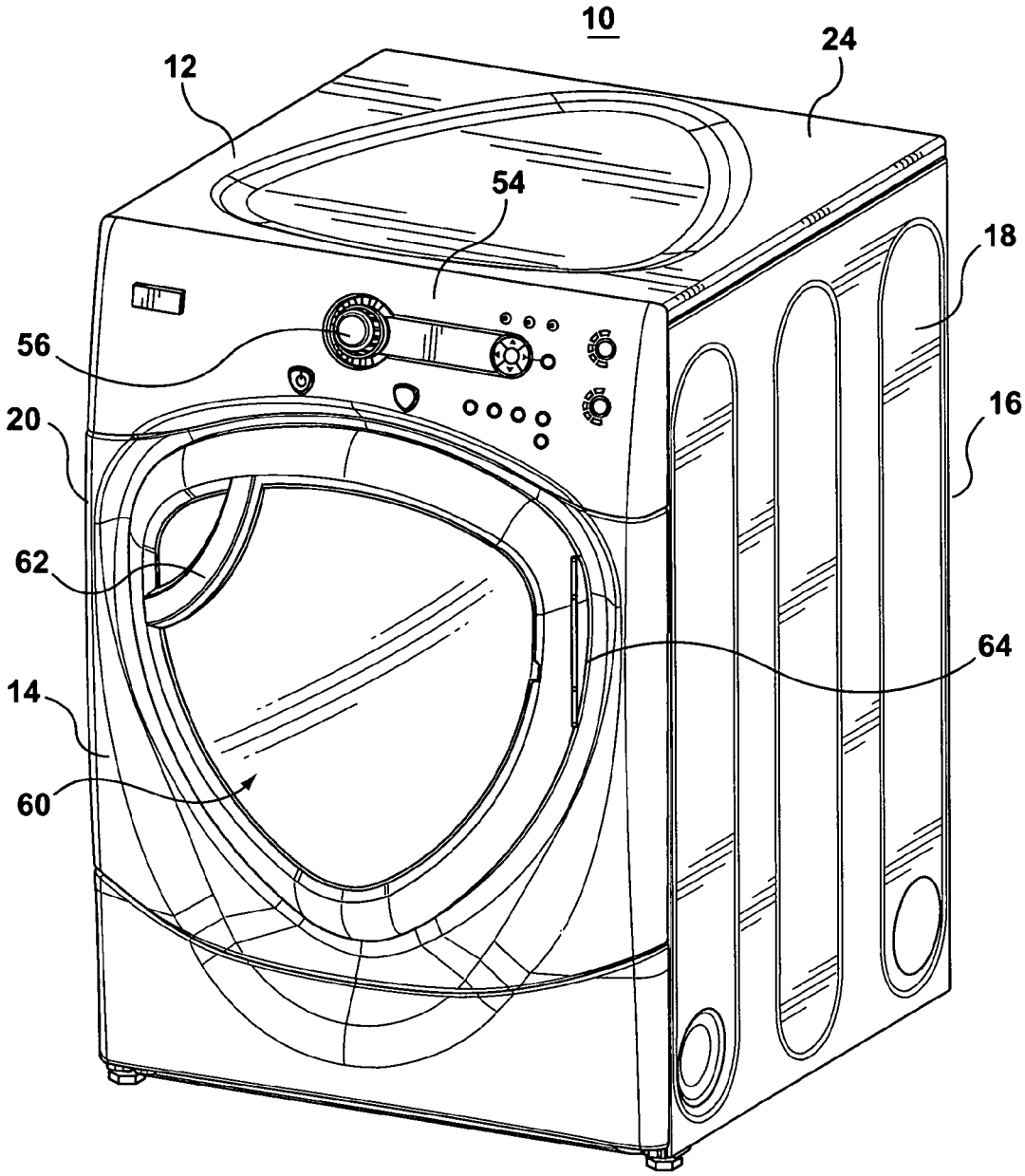
FIG. 1 is a perspective view of an exemplary clothes dryer that may benefit from the present invention.
Figure 2:
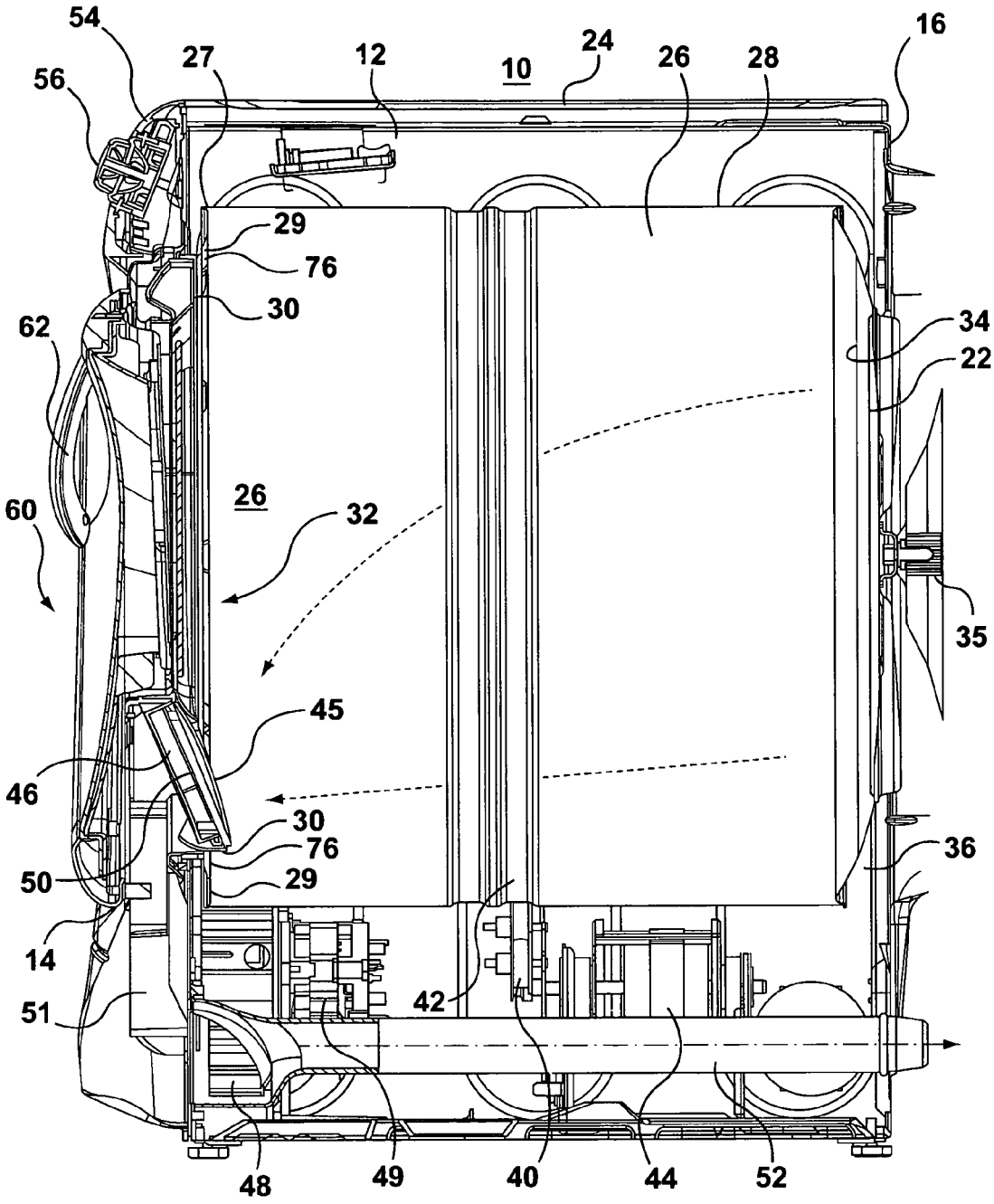
FIG. 2 is a side sectional view of an exemplary clothes dryer that may benefit from the present invention; and, FIG. 3 is a perspective inside view showing an exemplary bulkhead structure mounted to the front panel of the clothes dryer; and, FIG. 4 is an enlarged exemplary view of one of the side wall portions of the bulkhead structure.

FIGS. 1 and 2 show perspective and side sectional views of an exemplary clothes dryer 10 that may benefit from the present invention. The clothes dryer 10 includes a cabinet or a main housing 12 having a front panel 14, a rear panel 16, a pair of side panels 18 and 20 spaced apart from each other by the front and rear panels, and a top cover 24. Within the housing 12 is a drum or container 26 mounted for rotation around a substantially horizontal axis. A motor 44 rotates the drum 26 about the horizontal axis through, for example, a pulley 40 and a belt 42. The drum 26 is generally cylindrical in shape, has an imperforate outer cylindrical wall 28, and has an open end 27 that typically comprises a metal ring 29 or reduced diameter that is attached by welding to the drum for reducing the diameter of the opening of the drum 26 to match a front bulkhead structure 30. The bulkhead structure 30 further defines an access opening 32 into the drum 26. Access opening 32 has a reduced area across it as compared to the area across the open end 27 of the drum 26. Clothing articles and other fabrics are loaded into the drum 26 through the access opening 32. A plurality of tumbling ribs (not shown) are provided within the drum 26 to lift the articles and then allow them to tumble back to the bottom of the drum as the drum rotates. The drum 26 includes a rear wall 34 rotatably supported within the main housing 12 by a suitable fixed bearing 35. The rear wall 34 includes a plurality of holes (not shown) that receive hot air that has been heated by a heater such as electrical heating elements (not shown) in the heater housing 22. The housing 22 receives ambient air via an inlet 36. Although the exemplary clothes dryer 10 shown in FIG. 1 is an electric dryer, it could just as well be a gas dryer having a gas burner.

The dryer has a control panel 54 with touch and or dial controls 56 whereby a user can control the operation of the dryer 10. Also, the access opening 32 is shown closed by a window or port-hole like door 60. Door 60 has a handle 62 for pivotally opening the door about hinge 64.

Heated air is drawn from the drum 26 by a blower fan 48 which is also driven by a second motor 49 in the embodiment shown. In an alternative embodiment, motor 44 could be used to drive blower fan 48 thereby eliminating the need for second motor 49. Second motor 49 allows the drum 26 to rotate in opposing directions whereas the use of a single motor to drive both the drum 26 and blower fan 48 would rotate in one direction only. The air passes through a grill 45 and screen filter 46. Grill 45 keeps clothing articles tumbling in the drum 26 from contacting the filter 46 and touching the lint trapped by the filter 46 within the trap duct 50. As the air passes through the screen filter 46, it flows through lower duct portion 51 and is drawn by blower wheel 48 attached to motor 49 out of the clothes dryer through an exhaust duct 52. In this embodiment, the drum 26 is in air flow communication with the trap duct 50 whose lower duct portion 51 has an outlet that is in air flow communication with the blower wheel 48 and the exhaust duct 52.

Figure 3:
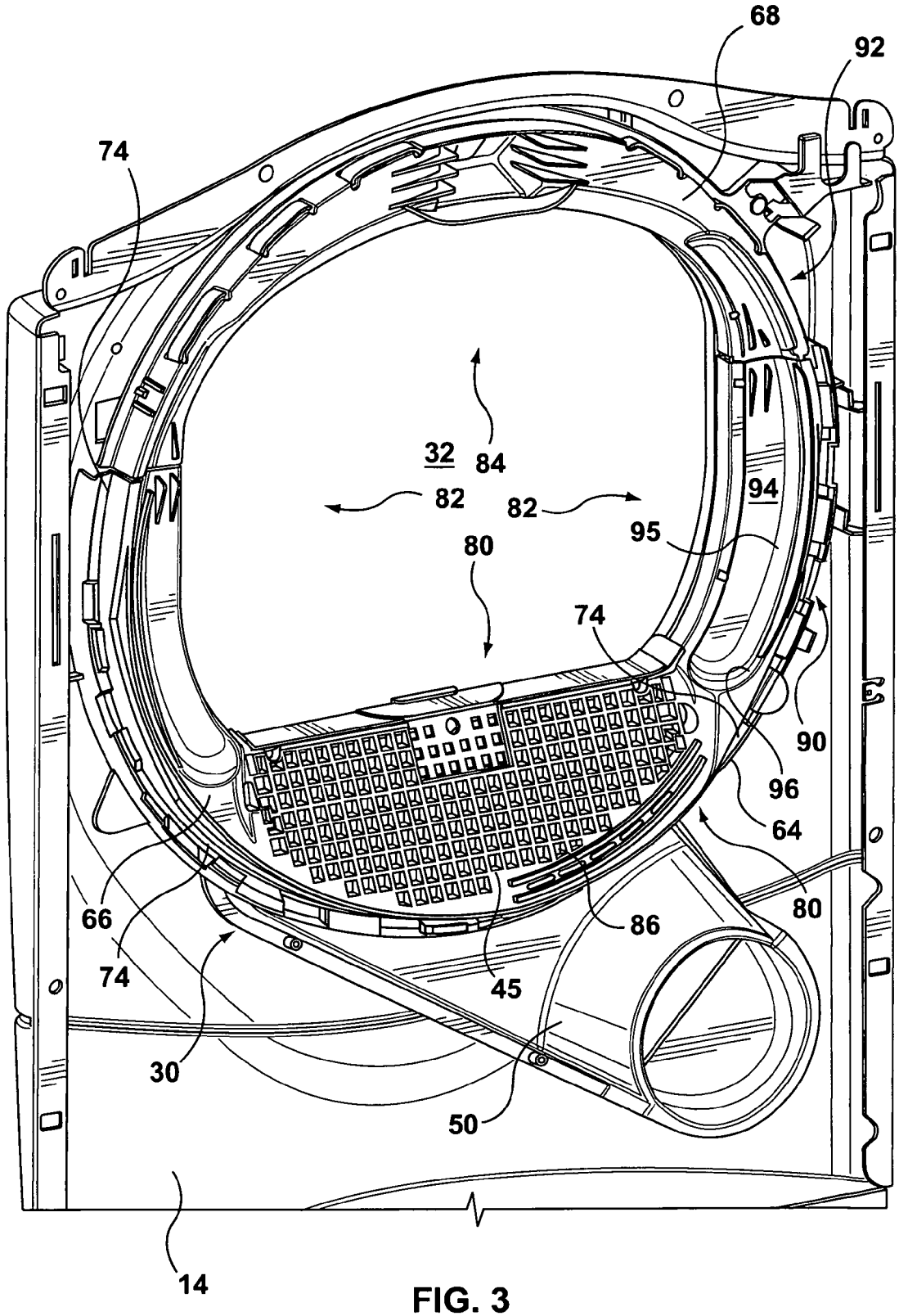
Figure 4:
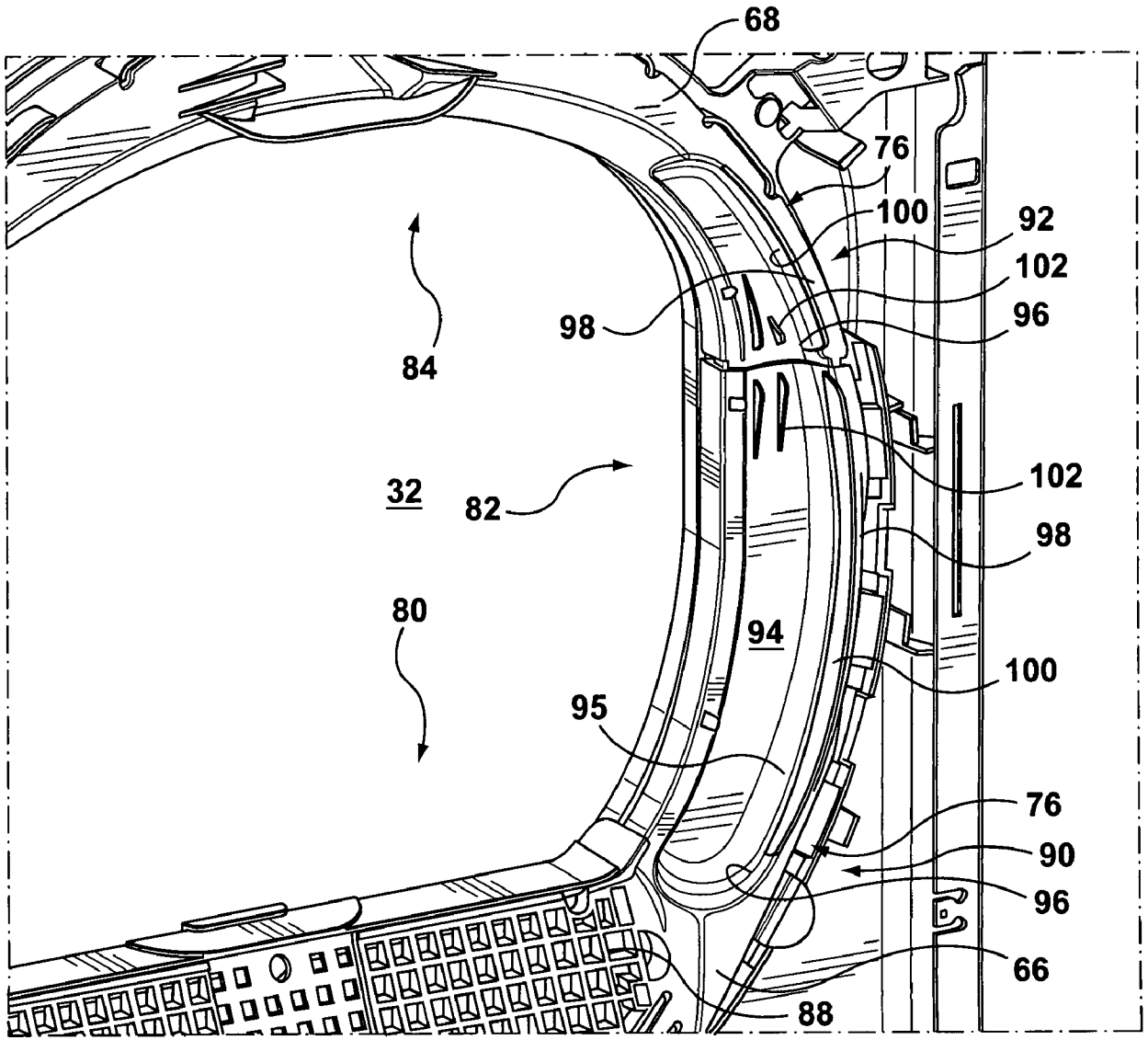

Referring to FIGS. 3 and 4, this embodiment of the bulkhead structure 30 is made up of two plastic molds of a lower bulkhead structure part 66 and an upper bulkhead structure part 68. The two parts are secured together and mounted by snapping hooks (not shown) to the front panel 14. The lower bearing structural part 66 and the upper bearing structural part 68 define a bulkhead junction 76.

The bulkhead structure 30 defines a generally cylindrical outer wall 74 which in this embodiment is a bearing support wall that fits within, or is surrounded by, the metal ring 29 at the open end 27 of the drum 26. In this manner, the metal ring 29 matches the outer wall 74 so as to rotate about the outer wall 74 during dryer operation. The outer wall 74 acts as a bearing support for the drum 26. In alternative embodiments roller bearings may be employed to support the drum 26. In this alternative embodiment the front bulkhead 30 carries little or no load of the drum 26. In the embodiment shown in FIGS. 3 and 4, the cylindrical outer wall 74 is generally cylindrical in the sense that it is not a continuous wall and therefore not a perfect cylinder. It should be understood that the cylindrical outer wall 74 forms with the metal ring 29 at the open end 27 of the drum 26 a junction 76 (see FIG. 2) that is cylindrical in shape and follows the outer circumference of the cylindrical outer wall 74. This junction 76 is an area in previous dryer constructions where clothes have been known to come into contact with resulting in damaging or soiling of the clothes.

As shown in FIG. 3 the bulkhead access opening 32 is located within the cylindrical outer wall 74. Opening 32 has an area that is smaller than the open end 27 of the dryer drum 26. Below the bulkhead access opening 32, bulkhead 30 has a bottom wall portion 80 that faces into the dryer drum 26. The bottom wall portion 80 is also located within the cylindrical outer wall 74. The bottom wall portion 80 comprises the grill portion 45 that has a plurality of air exhaust openings 86. The grill portion 45 is angled into the drum downwardly and inwardly from the bulkhead access opening 32 so as to deflect clothing away from that portion of the junction 76 generally located below the grill portion 45.

Bulkhead 30 has two arcing side wall portions 82 that face into the drum and extend up on opposing sides from the bottom wall portion 80. The two arcing side wall portions 82 each extend between the bulkhead access opening 32 and the cylindrical outer wall 74. Bulkhead 30 has an arcuate top portion 84 that bridges the two arcing side wall portions 82. The arcuate top wall portion 84 extends between the bulkhead access opening 32 and the cylindrical outer wall 74. In the embodiment of the bulkhead structure 30 shown in FIGS. 3 and 4, the lower bulkhead part 66 includes the bottom wall portion 80 and first or lower portions 90 of each of the two arcuate side wall portions 82. The upper bulkhead structure part 68 includes the top wall portion 84 and second portions or upper portions 92 of each of the two arcing side wall portions 82. The side wall portions 82 each comprise a recess 94 that extends from the bulkhead access opening 32 towards the cylindrical outer wall 74. The recess 94 also extends between the top wall portion 84 and the bottom wall portion 80. The recess has a concave curvature 95 terminating in an outer deflection wall 96. The outer deflection wall 96 is inwardly spaced from the cylindrical outer wall 74. The outer deflection wall 96 generally extends parallel to the cylindrical outer wall 74. The concave curvature 95 also curves into both the arcuate top portion 84 and the bottom wall portion 80. The side wall portions 82 each define a generally normal wall 98 that faces into the drum 26 and is located between the outer deflection wall 96 and the cylindrical outer wall 74. The outer deflection wall 96 further has attached to it, or comprises as part of it, a flange or flanges 100. Flanges 100 extend into the dryer drum 26 farther than the normal wall 98 so as to facilitate the deflection of clothing articles away from the junction 76. In the embodiment shown the flanges 100 extend about 6 mm past normal wall 98. In operation, clothing tumbling within the dryer 10 and moving towards the front bulkhead 30 will contact the recesses 94 of the side wall portions 82. Clothing moving across the recesses 94 towards the junction 76 are deflected or swept in the curving motion by the concave surface 96, the outer deflection wall 96 and the flanges 100 away from the junction 76.

As best seen in FIG. 4, the upper and lower portions 92, 90 of the side wall portion 82 have raised ribs 102 that rise out of the recess surface 94 as the ribs 102 extend towards the bulkhead junction 70. The ribs 102 reduce the chance of clothing, swept along recess 94, contacting or becoming wedged in the bulkhead junction 70 between the upper and lower bulkhead parts 68 and 66.

While the invention has been described in terms of various specific embodiments, those skilled in the art will recognize that the invention can be practiced with modifications within the spirit and scope of the present invention as disclosed herein.

What is claimed is:

1. A clothes dryer comprising a dryer drum having an open end and a bulkhead structure fitting into the open end of the dryer drum, the bulkhead structure having an access opening of reduced area to that of the open end of the dryer, and the bulkhead structure comprising:

a generally cylindrical outer wall fitting within the open end of the dryer drum and forming a junction with the open end of the dryer drum;

two side wall portions facing into the drum on opposing sides of the bulkhead access opening, the side wall portions each comprising a recess extending from the bulkhead access opening towards the cylindrical outer wall, the recess terminating in an outer deflection wall inwardly spaced from the cylindrical outer wall, whereby the outer deflection wall causes clothing contacting the recess and moving towards the dryer drum to be directed away from the junction adjacent the recess.

2. The clothes dryer of claim 1 wherein the recess has a concave curvature adjacent the outer deflection wall.

3. The clothes dryer of claim 2 wherein the side wall portions each define a generally normal wall portion facing into the drum between the outer deflection wall and the cylindrical outer wall, and the outer deflection wall includes at least one flange extending therefrom and into the dryer drum farther than the normal wall to facilitate deflection of clothing articles away from the junction.

4. The clothes dryer of claim 1 wherein the outer deflection wall extends generally parallel to the cylindrical outer wall.

5. The clothes dryer of claim 4 wherein the side wall portions each define a generally normal wall portion facing into the drum between the outer deflection wall and the cylindrical outer wall, and the outer deflection wall includes at least one flange extending therefrom and into the dryer drum farther than the normal wall to facilitate deflection of clothing articles away from the junction.

6. The clothes dryer of claim 5 wherein the generally cylindrical outer wall of the bulkhead structure is a bearing rotatably supporting the open end of the dryer drum.

7. The clothes dryer of claim 5 wherein the bulkhead structure comprises a lower part and an upper part each molded from plastic.

8. The clothes dryer of claim 7 wherein the recess has elongated raised ribs adjacent a bulkhead junction between the lower and upper parts to deflect clothing away from the bulkhead junction.

9. The clothes dryer of claim 5 wherein the bulkhead structure comprises a bottom wall portion below the access opening, the bottom wall portion comprises a grill portion having a plurality of air exhaust openings, the grill portion being angled into the drum from the access opening to deflect clothing away from that portion of the junction generally below the grill portion.

10. The clothes dryer of claim 1 wherein the side wall portions each define a generally normal wall portion facing into the drum between the outer deflection wall and the cylindrical outer wall, and the outer deflection wall includes at least one flange extending therefrom and into the dryer drum farther than the normal wall to facilitate deflection of clothing articles away from the junction.

11. A clothes dryer comprising a dryer drum having an open end a front panel, and a bulkhead structure mounted to the front panel and fitting into the open end of the dryer drum relative to the front panel, the bulkhead structure comprising:

a generally cylindrical outer wall fitting within the drum access opening and forming a junction with the open end of the dryer drum;

a bulkhead access opening located within the cylindrical outer wall and being smaller in area than that of open end of the dryer drum;

a bottom wall portion facing into the dryer drum, and the bottom wall portion generally extending below the bulkhead access opening and within the cylindrical outer wall;

two arcing side wall portions facing into the drum and extending up on opposing sides from the bottom wall portion between the bulkhead access opening and the cylindrical outer wall;

an arcuate top portion bridging the two arcing side wall portions and extending between the bulkhead access opening and the cylindrical outer wall; and the side wall portions each comprising a recess extending from the bulkhead access opening towards the cylindrical outer wall and between the top wall portion and the bottom wall portion, the recess terminating in an outer deflection wall inwardly spaced from the cylindrical outer wall, whereby the recess and the outer deflection wall cause clothing contacting the recess and moving towards the dryer drum to be directed away from the junction adjacent the recess.

12. The clothes dryer of claim 11 wherein the outer deflection wall extends generally parallel to the cylindrical outer wall.

13. The clothes dryer of claim 12 wherein the side wall portions each define a generally normal wall portion facing into the drum between the outer deflection wall and the cylindrical outer wall, and the outer deflection wall comprises at least one flange extending into the dryer drum farther than the normal wall to facilitating deflection of clothing articles away from the junction.

14. The clothes dryer of claim 11 wherein the side wall portions each define a generally normal wall portion facing into the drum between the outer deflection wall and the cylindrical outer wall, and the outer deflection wall comprises at least one flange extending therefrom and into the dryer drum farther than the normal wall to facilitate deflection of clothing articles away from the junction.

15. The clothes dryer of claim 14 wherein the generally cylindrical outer wall of the bulkhead structure is a bearing rotatably supporting the open end of the dryer drum.

16. The clothes dryer of claim 14 wherein the bulkhead structure comprises a lower part and an upper part each moulded from plastic, the lower part comprising the bottom wall portion and first portions of each of the two arcuate side wall portions, and the upper part comprising the arcuate top wall portion and second portions of each of the two arcing side wall portions.

17. The clothes dryer of claim 16 wherein the recess has elongated raised ribs adjacent a bulkhead junction between the lower and upper parts to deflect clothing away from the bulkhead junction.

18. The clothes dryer of claim 14 wherein the bottom wall portion comprises a grill portion having a plurality of air exhaust openings, the grill portion being angled into the drum from the access opening to deflect clothing away from that portion of the junction generally below the grill portion.

* * * * *